United States Patent [19]

Thompson

[11] 4,162,794

[45] Jul. 31, 1979

[54] GOLF CLUB HEAD SOLE PLATE WITH STUDS INTERLOCKING TO HEAD LAMINATIONS

[76] Inventor: Stanley C. Thompson, 7851 Talbert St., Apt. 1, Playa del Rey, Calif. 90271

[21] Appl. No.: 859,324

[22] Filed: Dec. 12, 1977

[51] Int. Cl.[2] ..... A63B 53/04

[52] U.S. Cl. ..... 273/174; 273/169

[58] Field of Search ..... 273/77 R, 80.2, 167 R, 273/167 F, 167 G, 167 A, 172, 173, 174, 169

[56] References Cited

U.S. PATENT DOCUMENTS

| | | | |
|---|---|---|---|
| 1,349,805 | 8/1920 | Booth | 273/174 |
| 1,502,328 | 7/1924 | Beat | 273/172 |
| 2,004,968 | 6/1935 | Young | 273/174 |
| 2,014,829 | 9/1935 | Young | 273/174 |
| 3,591,183 | 7/1971 | Ford | 273/167 R |
| 3,761,095 | 9/1973 | Thompson | 273/174 |
| 3,941,390 | 3/1976 | Hussey | 273/169 |
| 4,063,737 | 12/1977 | Tom et al. | 273/174 |

*Primary Examiner*—Richard J. Apley
*Attorney, Agent, or Firm*—William W. Haefliger

[57] ABSTRACT

A golf club head includes wooden laminations to which a metallic sole plate is attached. The plate defines one or more integral studs which project upwardly into recesses formed in the laminations. Stud penetration of and attachment to multiple laminations, as by bonding, assures impact load distribution to the head via the studs and the bonded together laminations penetrated by the studs, which in turn prevents delamination.

12 Claims, 9 Drawing Figures

GOLF CLUB HEAD SOLE PLATE WITH STUDS INTERLOCKING TO HEAD LAMINATIONS

BACKGROUND OF THE INVENTION

This invention relates generally to golf clubs, and more particularly concerns improvements in woods which employ heads made up of stacked laminations, and metallic plates attached to the undersides of such heads. More specifically, it concerns improvements to clubs of the type disclosed in my U.S. Pat. No. 3,761,095, disclosing a sole plate having a keel configuration.

When impact loads are transmitted to such metallic sole plates, the loads are typically transmitted to the wooden heads at points adjacent the plates. Where head laminations extend parallel to the plate, the load is transmitted to the few laminations adjacent the edges of the plate, and a tendency to destructive delamination can occur, particularly when a relatively immovable object such as a concealed rock is inadvertently struck. This problem is aggravated in that type of club disclosed in U.S. Pat. No. 3,761,095, wherein the sole plate carries a downwardly projecting keel which is more likely to strike objects concealed in the turf or ground. The attachment of such sole plates to the laminations as by screws is not an answer to the problem, since the edges of the threads form cracks in or between the laminations, encouraging delamination.

SUMMARY OF THE INVENTION

It is a major object of the invention to provide an improved sole plate of simple construction which will obviate the delamination problem described above. Basically, the plate is constructed to be received upwardly in a recess formed in the bottom of the head; and it carries at least one and preferably multiple metallic posts or studs projecting upwardly from the plate upper side into a corresponding opening or openings extending upwardly in the head from the recess, the vertical dimensions of the studs exceeding the combined thicknesses of at least two of the head laminations through which the studs project. Adhesive bonding material bonds the studs to the closely fitting walls of the head, whereby high impact loads are transmitted from the plate to substantial extents of the head above the lowermost laminations, preventing delamination.

Further, the sole plate may define a downwardly projecting, forwardly and rearwardly elongated keel, the studs being located at opposite sides of a vertical plane through the keel, the plane extending forwardly and rearwardly, whereby load balance is achieved in relation to the keel which typically is employed to aid play in the rough and which may come into contact with resistant objects such as stones, roots, etc. Both forward and rearward studs may be employed, and are typically located forwardly and rearwardly of peninsulas defined by the head to interfit the sole plate, as will appear. The studs have smooth walls or surfaces so as not to gouge into or between the laminations, preventing the starting of cracks which would favor delamination.

These as well as other objects and advantages of the invention, as well as the details of an illustrative embodiment, will be more fully understood from the following description and drawings, in which:

DRAWING DESCRIPTION

DETAILED DESCRIPTION

Figure 1:
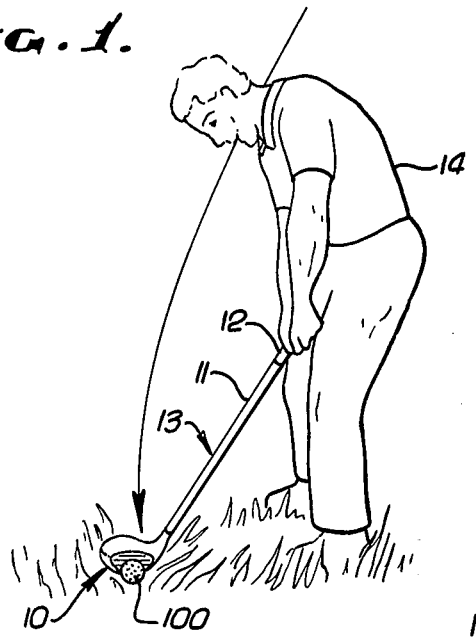
FIG. 1 is a frontal elevation showing use of the golf club.

Referring now to the drawings and particularly to FIG. 1, a golf club head embodying the present invention is generally indicated at 10 and is shown secured to a shaft 11. The latter has a conventional grip 12 to form an improved golf club 13. The club 13 is shown in hands of a golfer 14, just as the head 10 is about to engage the ball. At best seen in FIG. 2, the golf club head 10 generally includes an upwardly extending shaft receiving hosel 15, a body 16, and a sole plate 25.

The golf club head 10 is shown in the preferred embodiment as being a "wood", with the wooden body 16 having front face 17. The latter may be of any conventional incline to the vertical, as indicated by angle $\alpha$ in FIG. 4. The front face 17 has a centrally located cutout 18 for a trapezoidal panel 35. The body 16 is bulged at 19 behind the front face 17 as is conventional for a wood. The body 16 also has a lower surface 20 with a cutout 21 for receiving the sole plate 25. The cutout 21 follows the shape of the sole plate 25 to be fitted therein, and has centrally located, opposed peninsulas 22 to locate the sole plate 25 with respect to the body 16. The sole plate may consist, for example of cast metal such as zinc or zinc aluminum alloy.

Figure 2:
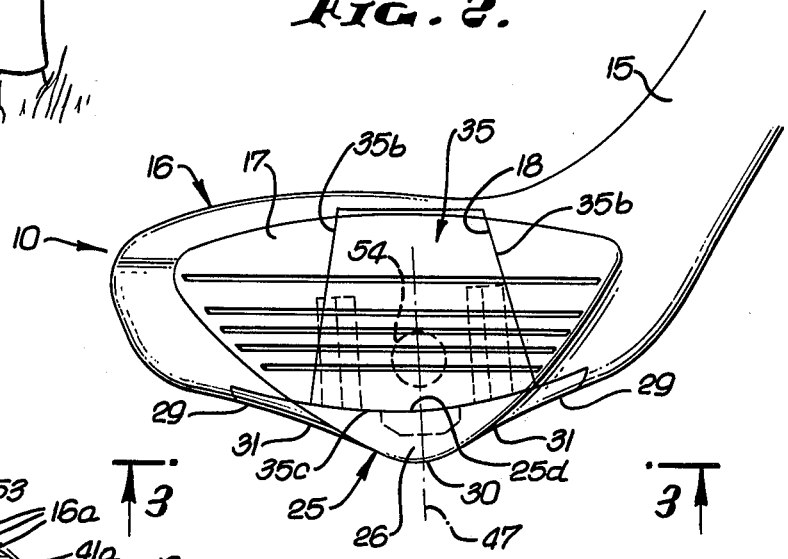
FIG. 2 is a frontal elevation showing a golf club head that incorporates the invention.
Figure 3:
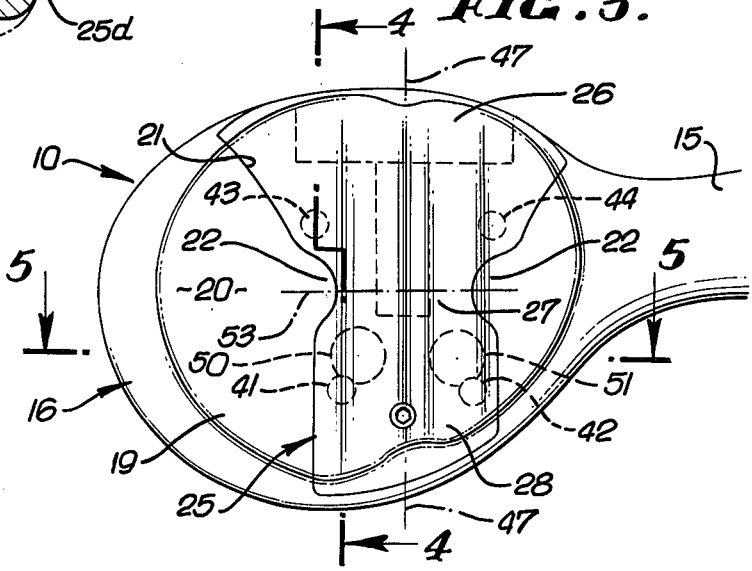
FIG. 3 is a bottom plan view on lines 3—3 of FIG. 2.
Figure 5:
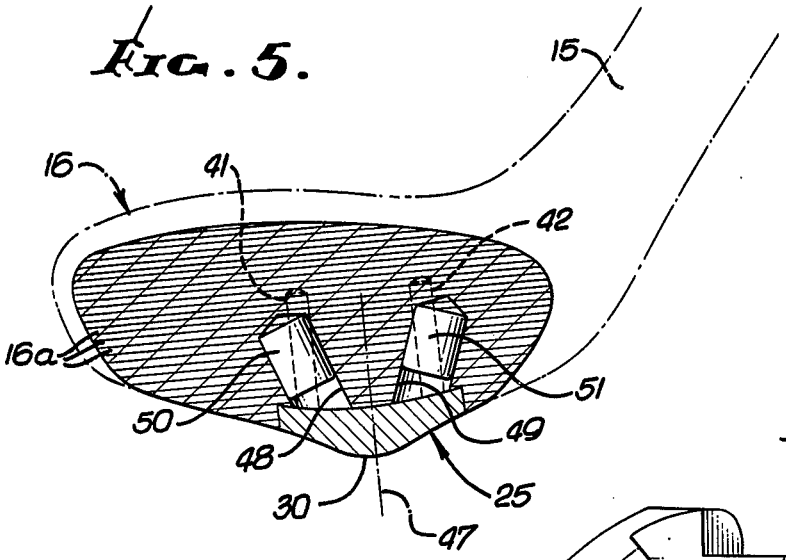
FIG. 5 is a section taken in elevation on lines 5—5 of FIG. 3.

As best seen in FIGS. 2 and 3, the sole plate 25 is shaped to mate with cut-out 21 in the lower surface 20 of the body 16. The sole plate 25 has a shallow V-shaped front face 26 which, when the sole plate 25 is located in the cut-out 21, provides an extension of the front face 17 of the body 16. The front face 26 is relatively wide and the sole plate 25 extends rearwardly therefrom to narrow into a waist 27 before spreading again at the rear end portion 28. The waist 27 mates with the centrally located opposed body peninsulas 22 to locate the sole plate 25 with respect to the body 16. The sole plate 25 is secured within the cutout 21 in the lower surface 20 of the body 16 by a bonding agent such as epoxy to bond the sole plate 25 and the body 16 together.

As seen in FIG. 2, the sole plate 25 has a lower surface 29 from which a longitudinally rearwardly and forwardly elongated keel 30 protrudes downwardly. In FIG. 3, the longitudinal keel 30 extends generally centrally from the front face 26 rearwardly along a line corresponding to the path of swing of the front face of the golf club head 10. The bottom of the keel 30, being lowermost, typically contacts the ground before the ball 100 is struck to space the major portion 29 of the lower surface of the plate 25 and lower surface 20 of the body 16 from the ground. Thus the area of contact with the ground is only the bottom of the keel 30.

In the preferred embodiment, keel 30 has downwardly concave sides 31. (See FIG. 2). The concave sides 31 blend smoothly with the downwardly convex keel 30 and the major portion 29 of the lower surface of plate 25. They tend to set up a favorable air flow over the lower surfaces 29 and 30 of the club head 10 as the club 13 is swung through the air; further, as the head 10 passes through the air, the keel 30 splits the air ahead of the club head 10 and the concave sides 31 direct the air outwardly as it passes over the lower surfaces 29 and 20. This pattern of air flow tends to separate and bend the grass as the head 10 approaches the ball (see FIG. 1) rather than crush the grass as the conventional flat bottomed head does.

The golf club head 10 is completed by the insertion of the trapezoidal panel 35 in the cutout 18 on the front face 17 of the body 16. The panel 35 typically consists of a hard plastic material which can engage a ball repeatedly without becoming dented or worn as the wood of the body 16 would otherwise become if such a panel 35 were not provided. A suitable bonding agent such as an epoxide may be employed to bond the rear wall 35*a*, sides 35*b* and bottom 35*c* of the insert to corresponding surfaces of the body and of the sole plate 25.

Figure 4:
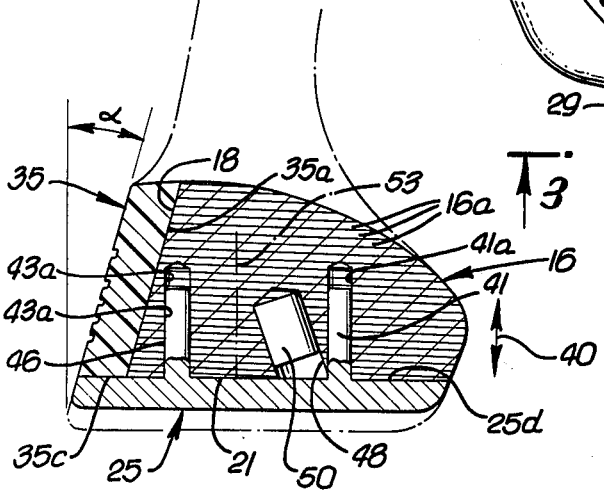
FIG. 4 is an elevation taken in section on lines 4—4 of FIG. 3.

As shown in FIG. 4, the body 16 is typically defined by a vertical stack of generally horizontal and parallel laminations 16*a* consisting of wooden sheets bonded together at their interfaces. As an example, there may be between 17 and 19 such laminations per inch in the direction of arrows 40 in FIG. 4. The strength of the club head, to resist impact of the ball, is thereby enhanced. However, the rather shallow thickness of the sole plate, in the direction of arrows 40, causes stress concentration at the lowermost laminations 16*a*, i.e. those below the level of the upper surface 25*d* of the plate 25, since at times the full impact load of the club head against a concealed rock or other object is transmitted from the sole plate to such lowermost laminations. This can cause destructive delamination.

In accordance with the invention, the sole plate carries or defines at least one stud and preferably multiple studs, integral with the plate and projecting upwardly from the plate upper side 25*d* into a corresponding opening or openings extending upwardly in the head from the cut-out or recess 21. As shown in the drawings, multiple studs 41-44 are shown projecting within and closely fitting corresponding drilled openings 41*a*–44*a* with vertical dimensions exceeding the combined thicknesses of at least two of the laminations through which the studs project. For best results, the studs project through at least about 10 laminations. Adhesive bonding material such as epoxide resin is employed as at 46 between the studs and the walls of the openings receiving them, to rigidly bond the studs to the laminations, whereby loading is transmitted to multiple laminations above the recess or cut-out 21 in response to heavy impact loading. Destructive delamination is thereby avoided since the load is sufficiently distributed to avoid it.

FIG. 3 shows that studs 41 and 43 are located at one side of a vertical plane 47 which bisects the keel 30, and studs 42 and 44 at the opposite side of the plane. Plane 47 extends forwardly and rearwardly and through the crest of the keel. Also, studs 43 and 44 are located forwardly of the peninsulas 22, and studs 41 and 42 rearwardly of the latter. Such spacing distributes the load over the club head, in balanced relation relative to the head and the sole plate. Plate side pockets 22*a* receive such peninsulas.

Figure 6:
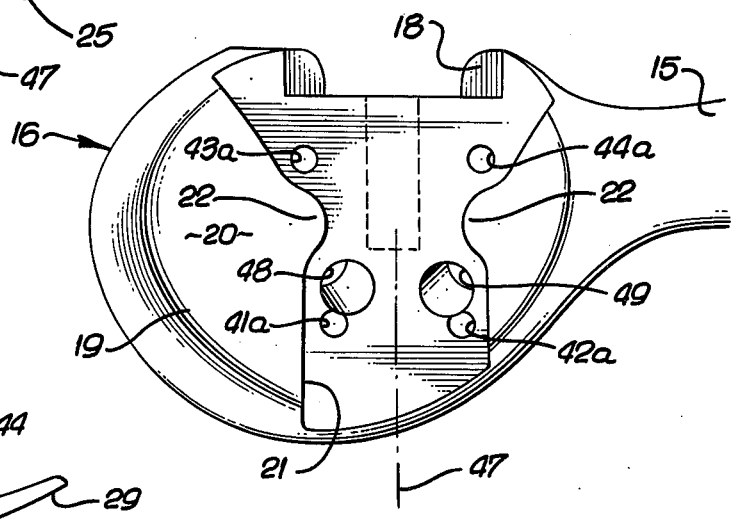
FIG. 6 is a bottom plan view like FIG. 3, but with the insert plate removed.

FIG. 6 illustrates the provision of two additional openings 48 and 49 projecting in the body 16 upwardly and forwardly as well as laterally away from plane 47, at angles from vertical, and at opposite sides of the plane 47. Such openings intersect the bottom surface of recess or cut-out 21, and are of larger diameter than the equal diameters of the studs, the latter being about ⅛ inch, for example. Concealed weights 50 and 51 are fitted in the recesses, which are typically located rearwardly of a lateral upright plane 53 bisecting the peninsulas 22, as is clear from FIGS. 3 and 4. The weights are typically bonded in position, in their associated openings. FIGS. 2 and 3 show the outline 54 of an additional cylindrical opening to receive weighting material, and which extends rearwardly into the body 16 above the keel and from a position intersecting the cut-out 18. Plane 47 bisects opening 54.

Figure 8:
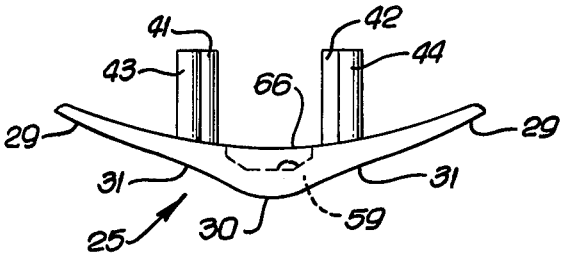
FIG. 8 is an end elevation on lines 8—8 of FIG. 7.
Figure 9:
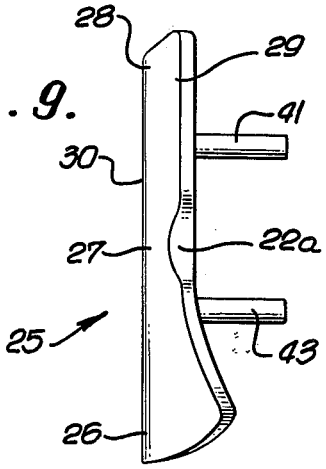
FIG. 9 is a side elevation on lines 9—9 of FIG. 7.
Figure 7:
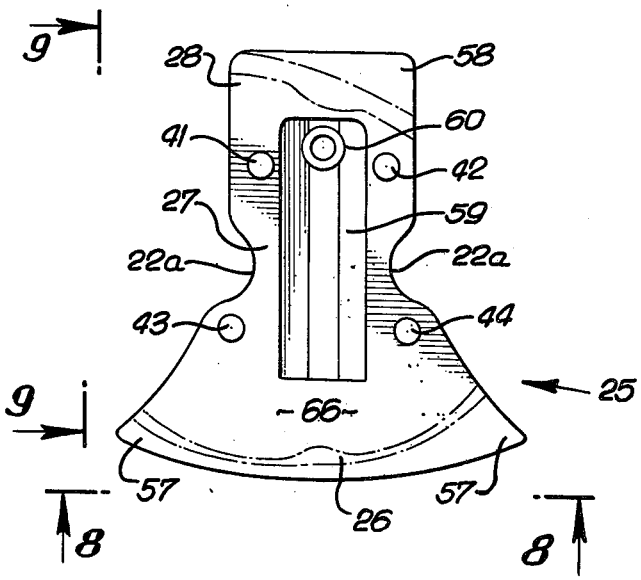
FIG. 7 is a bottom plan view of the insert plate in as molded condition, i.e. before trimming.

FIGS. 7–9 show the sole plate in as-cast condition, with ears 56 and 57 which are later partially cut-away or trimmed to match the contour of the wooden body 16, during assembly. Also, plate portion 58 is trimmed during such assembly. A central, elongated recess 59 is formed, for casting purposes, as in a pipe 60 in that recess. The recess intersects the concave upper surface 66 of the sole-plate, as shown. The symmetric construction is such that the FIGS. 7–9 sole plate may be used on either left or right handed club heads.

The studs 41–44 are smooth surfaced, as are their receiving openings 41*a*–44*a*, to prevent formation of cracks in or between the lamination, which would encourage delamination.

Openings 48 and 49 are located rearwardly of a lateral upright plane through the peninsulas 22, but forwardly of openings 43*a* and 44*a*, so as not to interfere with the latter.

I claim:

1. In combination with a golf club head having multiple laminations which extend in vertically stacked relation and generally horizontally, the head having a bottom surface and a recess sunk upwardly in the head from said bottom surface, there being a head lamination extending across the upper interior of the recess, the recess being everywhere several laminations deep in vertical dimensions, the improvement comprising (a) a metallic sole plate received upwardly into the recess, (b) the plate having an upper side and defining multiple studs projecting upwardly from said upper side into corresponding openings extending upwardly in the head from said recess, the vertical dimensions of the studs exceeding the combined thicknesses of at least two of the laminations through which the studs project, (c) there being adhesive bonding material bonding the studs to the walls of said openings, (d) the sole plate having a downwardly projecting keel which extends rearwardly from the front face of the club head, the studs located at opposite sides of and being spaced from a vertical plane which extends forwardly and rearwardly, and bisects said keel, the studs being generally parallel and being of one-piece integral construction with the sole plate, (e) the studs being generally cylindrical and vertically elongated, whereby the studs, bonding material and laminations cooperate to distribute impact loads to the keel and to the plate directly into multiple laminations at locations at opposite sides of said plane.

2. The combination of claim 1 wherein said keel has a downwardly convex surface, which is forwardly and rearwardly elongated.

3. The combination of claim 2 wherein the sole plate has underside faces at opposite sides of the keel, each face having downward concavity, the studs entirely confined vertically above said faces.

4. The combination of claim 1 wherein there are four of said studs, two of which are at one side of the plane and respectively forwardly and rearwardly spaced, and two of which are at the opposite side of said plane and respectively forwardly and rearwardly spaced.

5. The combination of claim 4 including at least one additional opening projecting upwardly in the head and at an angle from vertical from the recess uppermost extent, there being a weight retained in said recess and concealed by the plate, said additional opening and weight offset from the openings receiving said studs.

6. The combination of claim 5 wherein there are two of said additional openings, and weights retained therein, and respectively at opposite sides of said plane, said additional openings located between the forward and rearward stud receiving openings.

7. The combination of claim 4 wherein the plate has side pockets for receiving peninsulas formed by the head, the pockets located at opposite sides of said plane, two of said studs located forwardly of said side pockets, and two of the studs located rearwardly of the side pockets.

8. The combination of claim 1 wherein the laminations are of equal thickness, there being between about 17 and 19 laminations per inch as measured vertically of the head.

9. For combination with a golf club head having multiple laminations which extend in vertically stacked relation and generally horizontally, the head having a bottom surface and a recess sunk upwardly in the head from said bottom surface, there being a head lamination extending across the upper interior of the recess, the recess being everywhere several laminations deep in vertical dimension, the improvement comprising (a) a metallic sole plate received upwardly into the recess, (b) the plate having an upper side and multiple metallic studs projecting upwardly from said upper side for close reception into corresponding openings extending upwardly in the head from said recess and for adhesive bonding to the walls of said openings by bonding material, the vertical dimension of each stud exceeding the combined thicknesses of at least two of the laminations traversed by the opening receiving that stud, (c) the sole plate having a downwardly projecting keel which extends rearwardly from the front face of the club head, the studs located at opposite sides of and being spaced from a vertical plane which extends forwardly and rearwardly, and bisects said keel, the studs being generally parallel and being of one-piece integral construction with the sole plate, (d) the studs being generally cylindrical and vertically elongated, whereby the studs, bonding material and laminations cooperate to distribute impact loads to the keel and to the plate directly into multiple laminations at locations at opposite sides of said plane.

10. The combination of claim 9 wherein there are four of said studs, two of which are at one side of the plane and respectively forwardly and rearwardly spaced, and two of which are at the opposite side of said plane and respectively forwardly and rearwardly spaced.

11. The combination of claim 10 wherein the keel has a downwardly convex surface, which is forwardly and rearwardly elongated.

12. The combination of claim 11 wherein the sole plate has underside faces at opposite sides of the keel, each face having downward concavity, the studs entirely confined vertically above said faces.

* * * * *